US009152121B2

(12) United States Patent
Suenaga et al.

(10) Patent No.: US 9,152,121 B2
(45) Date of Patent: Oct. 6, 2015

(54) IMAGE FORMING APPARATUS HAVING A DEVELOPER COLLECTING DUCT

(71) Applicant: Konica Minolta, Inc., Chiyoda-ku, Tokyo (JP)

(72) Inventors: Takenori Suenaga, Tokyo (JP); Shingo Aoki, Kanagawa (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/059,992

(22) Filed: Oct. 22, 2013

(65) Prior Publication Data

US 2014/0112688 A1 Apr. 24, 2014

(30) Foreign Application Priority Data

Oct. 22, 2012 (JP) ..... 2012-232760

(51) Int. Cl.
*G03G 15/08* (2006.01)
*G03G 21/10* (2006.01)

(52) U.S. Cl.
CPC ..... *G03G 21/105* (2013.01); *G03G 21/10* (2013.01)

(58) Field of Classification Search
CPC ..... G03G 21/105
USPC ..... 399/257
See application file for complete search history.

(56) References Cited

U.S. PATENT DOCUMENTS 7,881,642 B2 * 2/2011 Walsh et al. ..... 399/257
8,346,151 B2 * 1/2013 Akaike et al. ..... 399/358
9,031,449 B2 * 5/2015 Goda et al. ..... 399/93
2009/0232570 A1 * 9/2009 Ozawa ..... 399/358
2010/0290824 A1 * 11/2010 Tanaka et al. ..... 399/359
2014/0314461 A1 * 10/2014 Ishizuka et al. ..... 399/358

(Continued)

FOREIGN PATENT DOCUMENTS

JP 2000275975 A 10/2000
JP 2003029486 A 1/2003

(Continued)

OTHER PUBLICATIONS

English machine translation of JP2004021132A; by Sekiguchi,Hajime; Otoguro,Yasuaki; Hatano,Fukashi; "Developer Collecting Device and Image Forming Apparatus"; published Jan. 22, 2004.*

(Continued)

*Primary Examiner* — David Gray
*Assistant Examiner* — Geoffrey Evans
(74) *Attorney, Agent, or Firm* — Cantor Colburn LLP

(57) ABSTRACT

An image forming apparatus includes: a developer collecting duct that is linear and has a plurality of coupling portions vertically spaced apart from each other; and a plurality of developer discharging sections that each have an engaging portion inserted into one of the coupling portions to thereby be disposed as being exposed to the inside of the developer collecting duct, and that discharge waste developer to the developer collecting duct through a developer outlet provided in the engaging portion. Second and subsequent ones of the developer discharging sections from the top are detachably attached to the developer collecting duct. The developer collecting duct has a flow path restricting portion that restricts the area through which the waste developer flows down to prevent the waste developer from hitting the engaging portion of lower one of the developer discharging sections.

7 Claims, 13 Drawing Sheets

(56) References Cited

U.S. PATENT DOCUMENTS

| | | | | |
|---|---|---|---|---|
| 2015/0023708 | A1* | 1/2015 | Lee et al. | 399/358 |
| 2015/0078776 | A1* | 3/2015 | Harada et al. | 399/99 |

FOREIGN PATENT DOCUMENTS

| | | | | |
|---|---|---|---|---|
| JP | 2004021132 | A | * | 1/2004 |
| JP | 2009103870 | A | | 5/2009 |

OTHER PUBLICATIONS

English machine translation of Japanese patent document, Hamaya et al. (JP2003029486A); "Image Forming Apparatus"; by Hamaya,Satoshi; Tashiro,Susumu; and lwasaki,Takahiro; published Jan. 29, 2003.*

Japanese Decision of Rejection corresponding to Application No. 2012-232760; Date of Mailing: Dispatch Date: Jun. 9, 2015, with English abstract.

* cited by examiner

IMAGE FORMING APPARATUS HAVING A DEVELOPER COLLECTING DUCT

CROSS REFERENCE TO RELATED APPLICATIONS

This application is entitled to and claims the benefit of Japanese Patent Application No.2012-232760, filed on Oct. 22, 2012, the disclosure of which including the specification, drawings and abstract is incorporated herein by reference in its entirety.

BACKGROUND OF THE INVENTION

1. Field of the Invention

The present invention relates to an electrophotographic image forming apparatus, and particularly to an image forming apparatus having a developer collecting section that collects developer containing deteriorated carrier or used developer in image formation (hereinafter referred to as waste developer).

2. Description of Related Art

In general, an image forming apparatus using an electrophotographic process technology (such as a printer, a copier, or a facsimile machine) irradiates (exposes) a charged photoconductor with (to) laser light based on image data to form an electrostatic latent image on the surface of the photoconductor. Toner is then supplied from a developing device to the photoconductor (image bearing member) bearing the electrostatic latent image, so that the electrostatic latent image is visualized as a toner image. The toner image is transferred to a sheet directly, or indirectly via an intermediate transfer belt, and fixed through heating and pressurization to form an image on the sheet.

Many image forming apparatuses employ a trickle development system. In the trickle development system, developer is regularly replaced by adding new developer (toner and carrier) while discharging developer (waste developer) containing deteriorated carrier. The waste developer discharged from developing devices in the trickle development system is all collected, for example in a collecting bottle through a developer collecting duct.

FIG. 1 illustrates developing devices and a developer collecting duct in a vertical tandem type image forming apparatus as viewed from the base end side (the side opposite to the side on which photoconductors are located) in the X direction. FIG. 2 illustrates the developing devices and the developer collecting duct in the vertical tandem type image forming apparatus as viewed from the base end side in the Y direction. FIG. 3 is a sectional view along a line A-A in FIG. 1. In FIGS. 1 to 3, the X axis represents the horizontal direction, the Z axis represents the vertical direction, and the Y axis represents a direction orthogonal to the X and Z axes (the direction of the axis of an agitating/conveying member).

As illustrated in FIGS. 1 and 2, the vertical tandem type image forming apparatus includes multiple developing devices (here, four developing devices for Y (yellow), M (magenta), C (cyan), and K (black)) 412Y, 412M, 412C, and 412K disposed in tiers in the vertical direction (Z direction). Developing devices 412Y, 412M, 412C, and 412K are treated as individual units and detachably attached to the body of the image forming apparatus. For example, developing devices 412Y, 412M, 412C, and 412K are mounted on a process carriage (not shown) and collectively attached to the body of the image forming apparatus. One end (on the base end side in the Y direction, i.e., the left side in FIG. 1) of each of developing devices 412Y, 412M, 412C, and 412K is coupled to developer collecting duct 170 linearly disposed in the vertical direction. The other end (on the tip end side in the Y direction, i.e., the right side in FIG. 1) is coupled to a power source (not shown), such as a driving motor, via a power transmission mechanism (not shown).

Specifically, as illustrated in FIG. 2, developer collecting duct 170 is provided with coupling portions 171Y, 171M, 171C, and 171K that accommodate and support the one end of respective developing devices 412Y, 412M, 412C, and 412K. Duct portions between adjacent upper and lower coupling portions, i.e., coupling portions 171Y and 171M, coupling portions 171M and 171C, and coupling portions 171C and 171K, are intermediate ducts 172.

As shown in FIG. 3, the one end of each of developing devices 412M and 412C is provided with pipe-like engaging portions 87M and 87C that house part of an agitating/conveying member (a developer conveying screw, not shown) and have developer outlets 89M and 89C, respectively. When engaging portions 87M and 87C are inserted into coupling portions 171M and 171C to attach developing devices 412M and 412C to developer collecting duct 170, developer outlets 89M and 89C are located inside developer collecting duct 170. Similarly, other developing devices 412Y and 412K are also coupled to developer collecting duct 170.

Unfortunately, coupling multiple developing devices 412Y, 412M, 412C, and 412K in tiers to developer collecting duct 170 as described above poses the following problem.

As illustrated in FIG. 3, engaging portions 87M and 87C of second and subsequent developing devices 412M and 412C are exposed to the inside of developer collecting duct 170. This causes waste developer T flowing from above to hit engaging portions 87M and 87C. Although engaging portions 87M and 87C of developing devices 412M and 412C are formed like a pipe in order to avoid accumulation of waste developer T, it is difficult to prevent accumulation of waste developer T over time. This also applies to fourth developing device 412K.

Waste developer T accumulated on engaging portions 87M and 87C may be scattered when developing devices 412Y, 412M, 412C, and 412K are detached during the time such as maintenance operation. The scattered waste developer may spill on, e.g., a sheet feeding path, causing poor images.

Such scattering of the waste developer may also occur in the case in which multi-tier cleaning devices for cleaning toner remaining on photoconductor drums are coupled to the developer collecting duct. That is, the above problem occurs in the case in which components that discharge waste developer (hereinafter referred to as developer discharging sections), such as developing devices or cleaning devices, are coupled in tiers to a developer collecting duct.

Techniques for preventing scattering of waste developer during maintenance operation include Japanese Patent Application Laid-Open Nos. 2009-103870 (PTL 1) and 2000-275975 (PTL 2), for example. PTL 1 and 2 disclose techniques for preventing scattering of waste developer using a receiver to receive the waste developer spilling from, e.g., developing devices. The techniques described in PTL 1 and 2, however, do not prevent the scattering itself of the waste developer and therefore are insufficient as preventive measures.

SUMMARY OF THE INVENTION

An object of the present invention is to provide an image forming apparatus that can ensure prevention of scattering of waste developer when developer discharging sections, such as developing devices or cleaning devices, are detached from a developer collecting duct, thereby preventing the occurrence of poor images due to scattered waste developer.

To achieve at least one of the abovementioned objects, an image forming apparatus reflecting one aspect of the present invention includes:

a developer collecting duct that is linear and has a plurality of coupling portions vertically spaced apart from each other; and a plurality of developer discharging sections that each have an engaging portion inserted into one of the coupling portions to thereby be disposed as being exposed to the inside of the developer collecting duct, and that discharge waste developer to the developer collecting duct through a developer outlet provided in the engaging portion, wherein second and subsequent ones of the developer discharging sections from the top are detachably attached to the developer collecting duct, and the developer collecting duct has a flow path restricting portion that restricts the area through which the waste developer flows down to prevent the waste developer from hitting the engaging portion of lower one of the developer discharging sections.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention will be described in detail with reference to the accompanying drawings.

Figure 1:
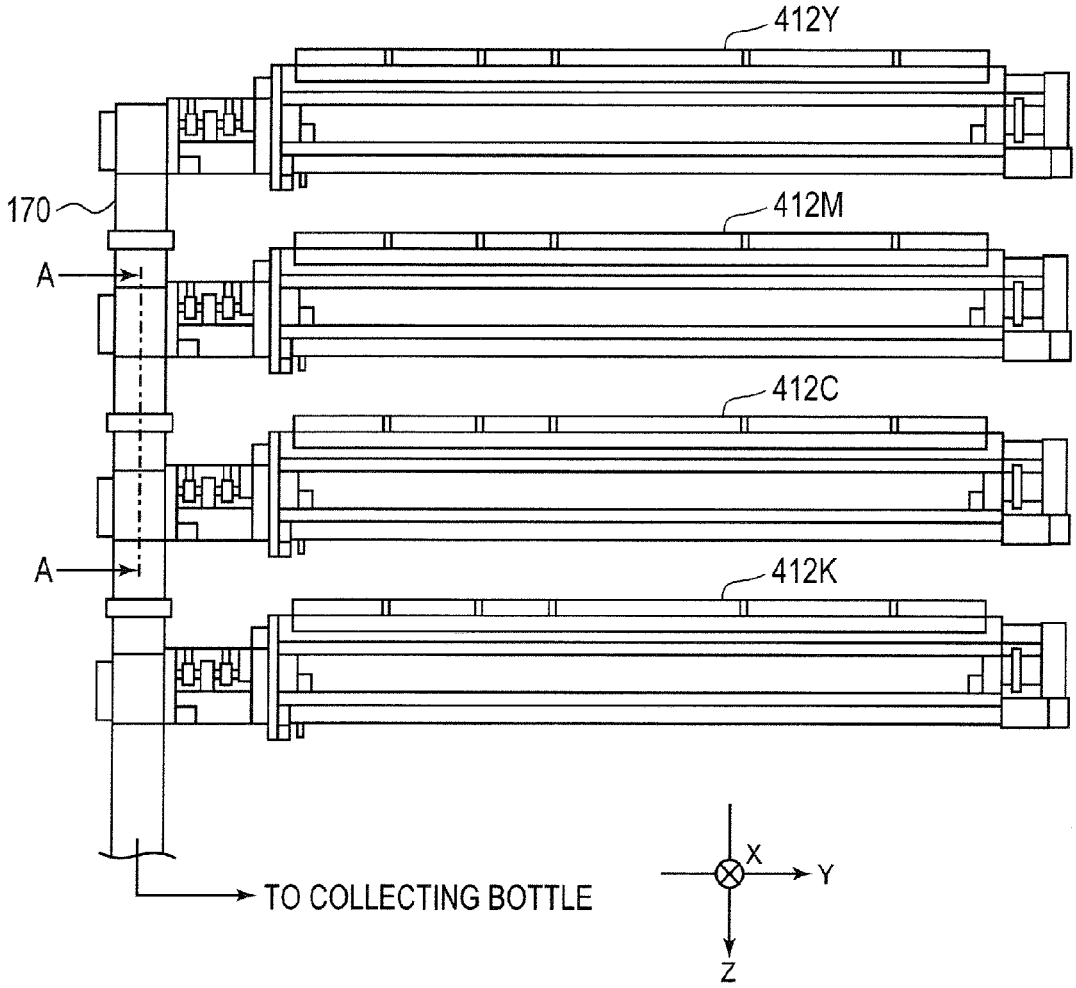
FIG. 1 illustrates developing devices and a developer collecting duct in a vertical tandem type image forming apparatus as viewed from the base end side in the X direction.
Figure 2:
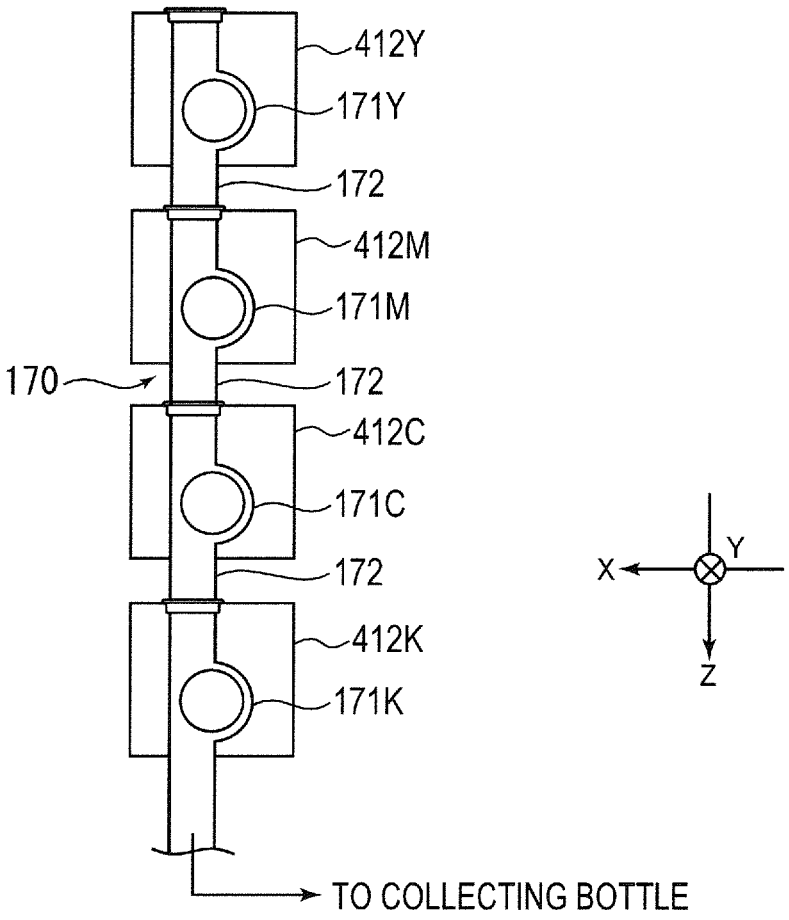
FIG. 2 illustrates the developing devices and the developer collecting duct in the vertical tandem type image forming apparatus as viewed from the base end side in the Y direction.
Figure 3:
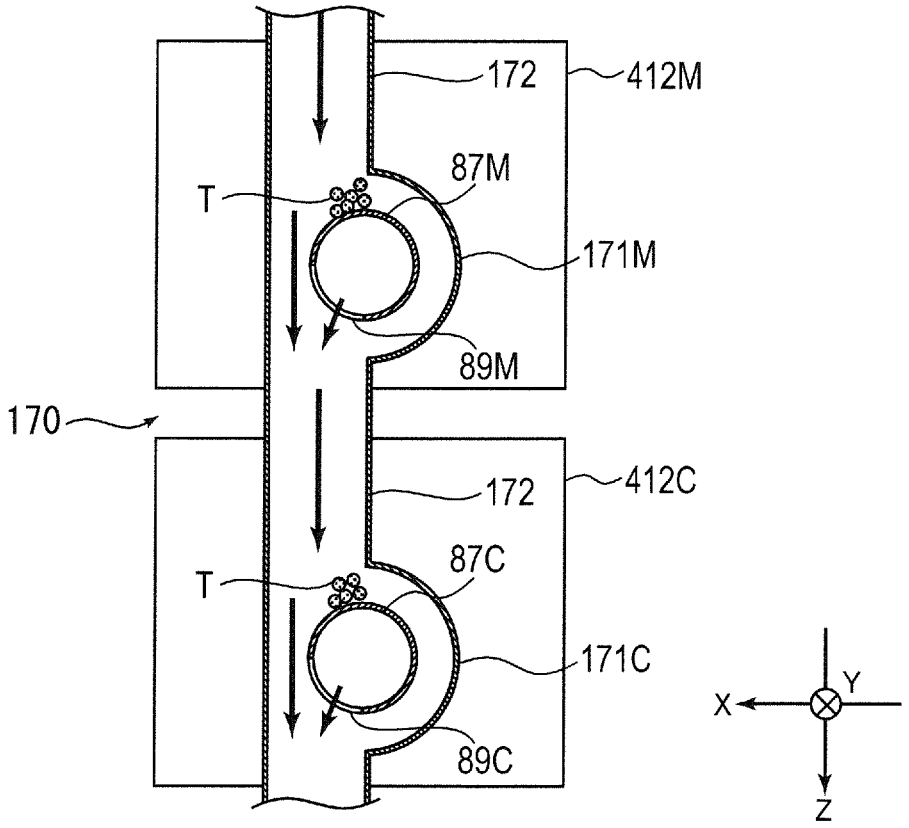
FIG. 3 is a sectional view along a line A-A in FIG. 1.
Figure 4:
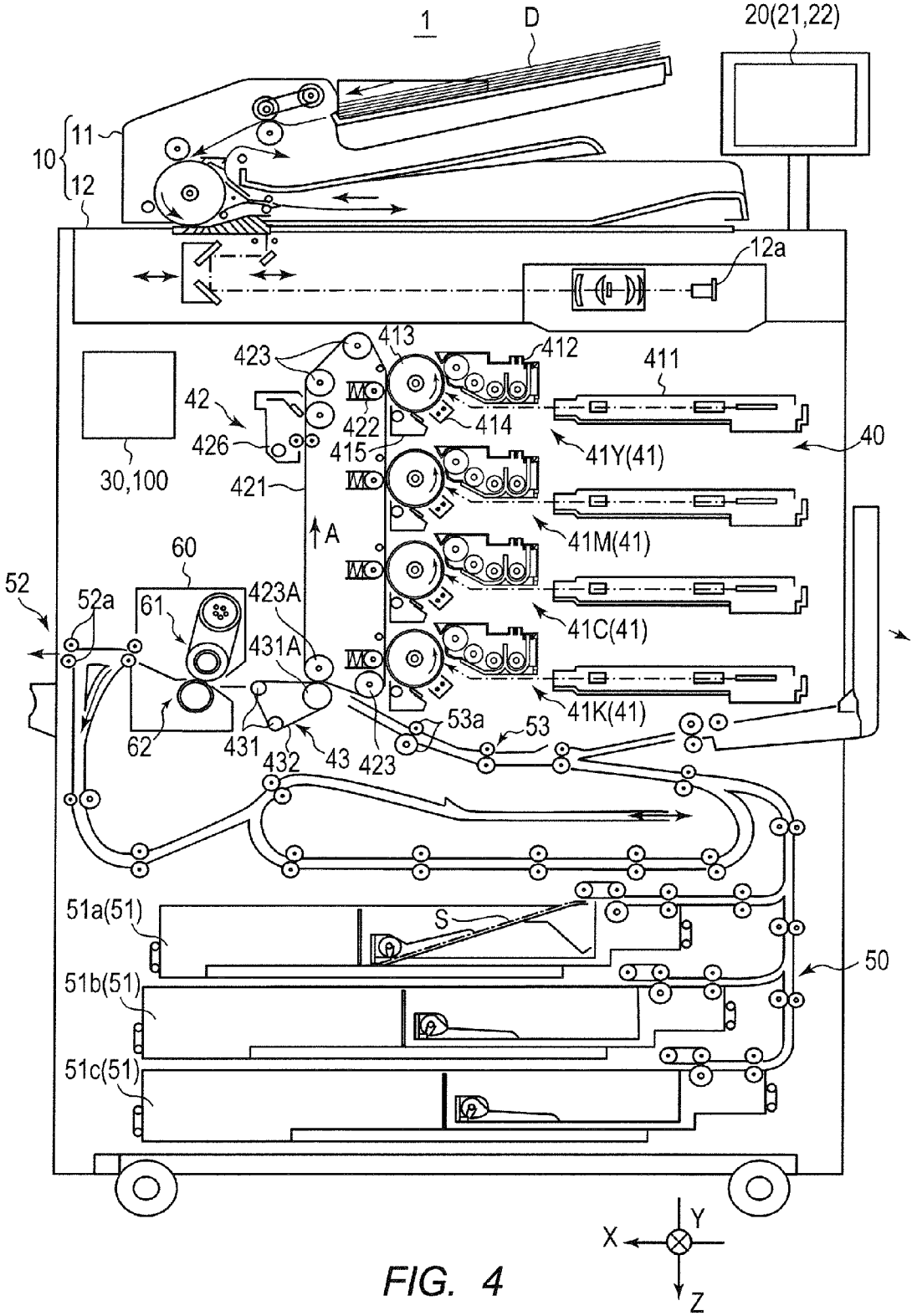
FIG. 4 illustrates an overall configuration of an image forming apparatus according to an embodiment of the present invention.

FIG. 4 illustrates an overall configuration of image forming apparatus 1 according to the embodiment of the present invention. Image forming apparatus 1 illustrated in FIG. 4 is a color image forming apparatus with an intermediate transfer system using electrophotographic process technology. Image forming apparatus 1 employs a vertical tandem system. In the vertical tandem system, photoconductor drums 413 corresponding to the four colors of YMCK are placed in series in the running direction of intermediate transfer belt 421 (vertical direction), and toner images of the respective colors are sequentially transferred to intermediate transfer belt 421 in one cycle.

That is, image forming apparatus 1 transfers (primarily transfers) respective toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondarily transfers) the resultant image to sheet S, to thereby form an image.

As illustrated in FIG. 4, image forming apparatus 1 includes image reading section 10, operation/display section 20, image processing section 30, image forming section 40, sheet conveying section 50, and fixing section 60. Each of these blocks is controlled by control section 100 that includes a central processing unit (CPU), read only memory (ROM), random access memory (RAM), and the like. Specifically, the CPU reads a program depending on processing details from the ROM, loads the program onto the RAM, and centrally controls the operation of each block of image forming apparatus 1 in cooperation with the loaded program.

Image reading section 10 includes auto document feeder (ADF) 11, document image scanner 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of reading results provided by document image scanner 12. Image processing section 30 performs predetermined image processing on the input image data.

Operation/display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings, on the input image data, and the like. For example, image processing section 30 performs toner correction on the basis of toner correction data (toner correction table), under the control of control section 100. In addition to the toner correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41 for images of colored toners respectively containing a Y component, an M component, a C component, and a K component on the basis of the input image data; intermediate transfer unit 42; and secondary transfer unit 43, and the like.

Image forming units 41 include four image forming units 41Y, 41M, 41C, and 41K for the Y, M, C, and K components, respectively. Since image forming units 41Y, 41M, 41C, and 41K have similar configurations, common elements are denoted by the same reference signs for convenience of illustration and description. Only when elements need to be differentiated among the units, Y, M, C, or K is added to their reference signs. In FIG. 4, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, and drum cleaning device 415.

Photoconductor drum 413 is, for example, a negatively-charged-type organic photoconductor (OPC) formed by sequentially laminating an under coat layer (UCL), a charge generation layer (CGL), and a charge transport layer (CTL) on the circumferential surface of a conductive cylindrical body (elementary tube) that is made of aluminum and has a drum diameter of 80 mm.

The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drum 413, whereby photoconductor drum 413 is rotated at a constant circumferential speed.

Charging device 414 evenly negatively charges the surface of photoconductor drum 413.

Exposure device 411 is configured by, for example, a semiconductor laser, and irradiates photoconductor drum 413 with laser light corresponding to the image of each color component. Because the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 due to a difference in potential from its surroundings.

Developing device 412 is of a two-component development system. Developing device 412 attaches the toner of each color component to the surface of photoconductor drum 413, and thus visualizes the electrostatic latent image to form a toner image. Developing device 412 employs a trickle development system. In the trickle development system, developer is regularly replaced by adding new developer (toner and carrier) while discharging developer (waste developer) containing deteriorated carrier. The waste developer discharged from developing device 412 flows down through developer collecting duct 70 (see FIG. 6) to be collected in a collecting bottle (not shown). A detailed configuration of developing device 412 will be described later.

Drum cleaning device 415 includes a drum cleaning blade that is brought into sliding contact with the surface of photoconductor drum 413, and removes residual toner that remains on the surface of photoconductor drum 413 after primary transfer.

Intermediate transfer unit 42 includes intermediate transfer belt 421, a plurality of support rollers 423 including backup roller 423A, and belt cleaning device 426.

Intermediate transfer belt 421 is configured by an endless belt, and is stretched on the plurality of support rollers 423 in a loop-like manner. At least one of the plurality of support rollers 423 is configured by a driving roller, and the others are each configured by a driven roller. Support roller 423 that functions as the driving roller rotates, whereby intermediate transfer belt 421 runs at a constant speed in the arrow A direction. Intermediate transfer belt 421 is brought into pressurized contact with photoconductor drums 413 by primary transfer rollers 422, whereby the toner images of the four colors are primarily transferred to intermediate transfer belt 421 so as to be sequentially superimposed on each other.

Secondary transfer unit 43 has a configuration such that secondary transfer belt 432 is stretched in a loop-like manner on multiple support rollers 431 including secondary transfer roller 431A.

Secondary transfer roller 431A is brought into pressurized contact with backup roller 423A across intermediate transfer belt 421 and secondary transfer belt 432, whereby transfer nip is formed. When sheet S passes through transfer nip, the toner images carried on intermediate transfer belt 421 are secondarily transferred to sheet S. Specifically, a voltage (transfer bias) having a polarity opposite to that of the toner is applied to secondary transfer roller 431A, whereby the toner images are electrostatically transferred to sheet S. Sheet S to which the toner images have been transferred is conveyed to fixing section 60 by secondary transfer belt 432.

Belt cleaning device 426 includes a belt cleaning blade that is brought into sliding contact with the surface of intermediate transfer belt 421, and removes residual toner that remains on the surface of intermediate transfer belt 421 after secondary transfer.

Fixing section 60 includes fixing-side member 61 (for example, a fixing belt) and rear-side support member 62 (for example, a pressure roller). Fixing-side member 61 and rear-side support member 62 form a fixing nip. Fixing section 60 heats and pressurizes sheet S conveyed thereto at the fixing nip, thereby fixing the toner images to sheet S. Fixing section 60 may include an air separation unit that blows air to separate sheet S from fixing-side member 61 or rear-side support member 62.

Sheet conveying section 50 includes sheet feed section 51, sheet ejection section 52, sheet conveying path 53, and the like.

Three sheet feed tray units 51*a* to 51*c* included in sheet feed section 51 house sheets S (standard sheets, special sheets) discriminated on the basis of the basis weight, the size, and the like, for each type set in advance.

Multiple paired conveyance rollers such as paired sheet stop rollers 53*a* are disposed along sheet conveying path 53.

Sheets S in sheet feed tray units 51*a* to 51*c* are sent out one by one from the topmost sheet and conveyed to image forming section 40 through sheet conveying path 53. At this time, a sheet stop roller section including paired sheet stop rollers 53*a* corrects the inclination of sheet S fed thereto, and adjusts conveyance timing thereof Then, image forming section 40 collectively secondarily transfers the toner images on intermediate transfer belt 421 to one surface of sheet S, and fixing section 60 performs a fixing process thereon. Sheet S on which an image has been formed is ejected to the outside of the apparatus by sheet ejection section 52 including ejection rollers 52*a*.

Figure 5:
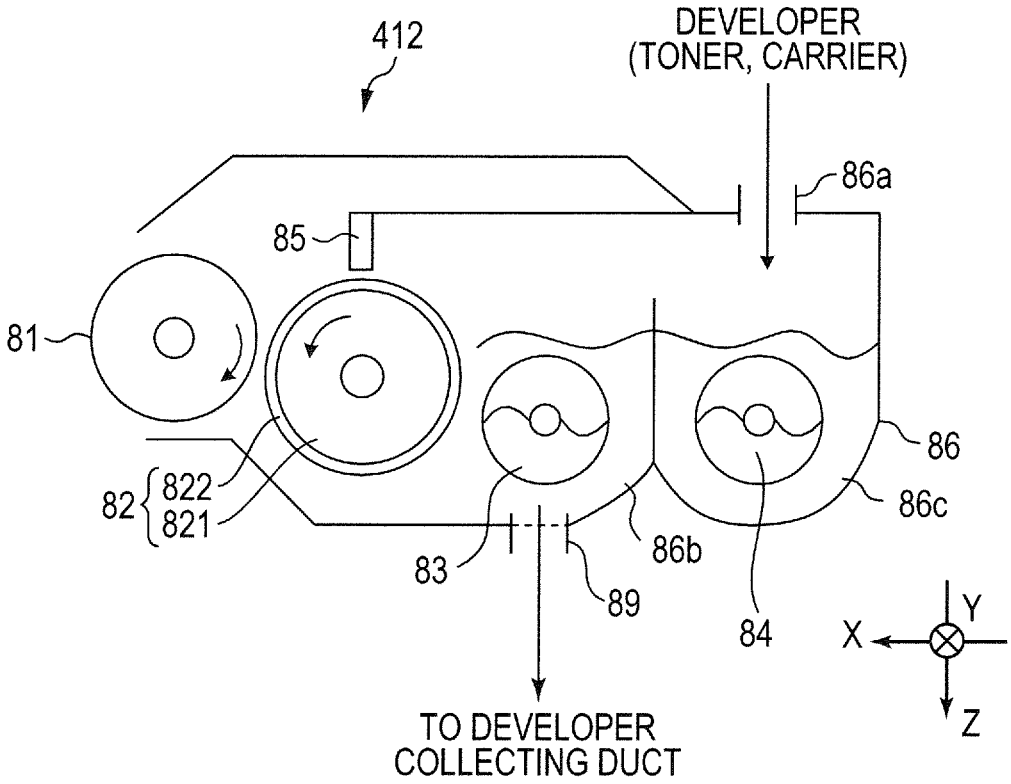
FIG. 5 illustrates an exemplary configuration of a developing device in the embodiment.
Figure 6:
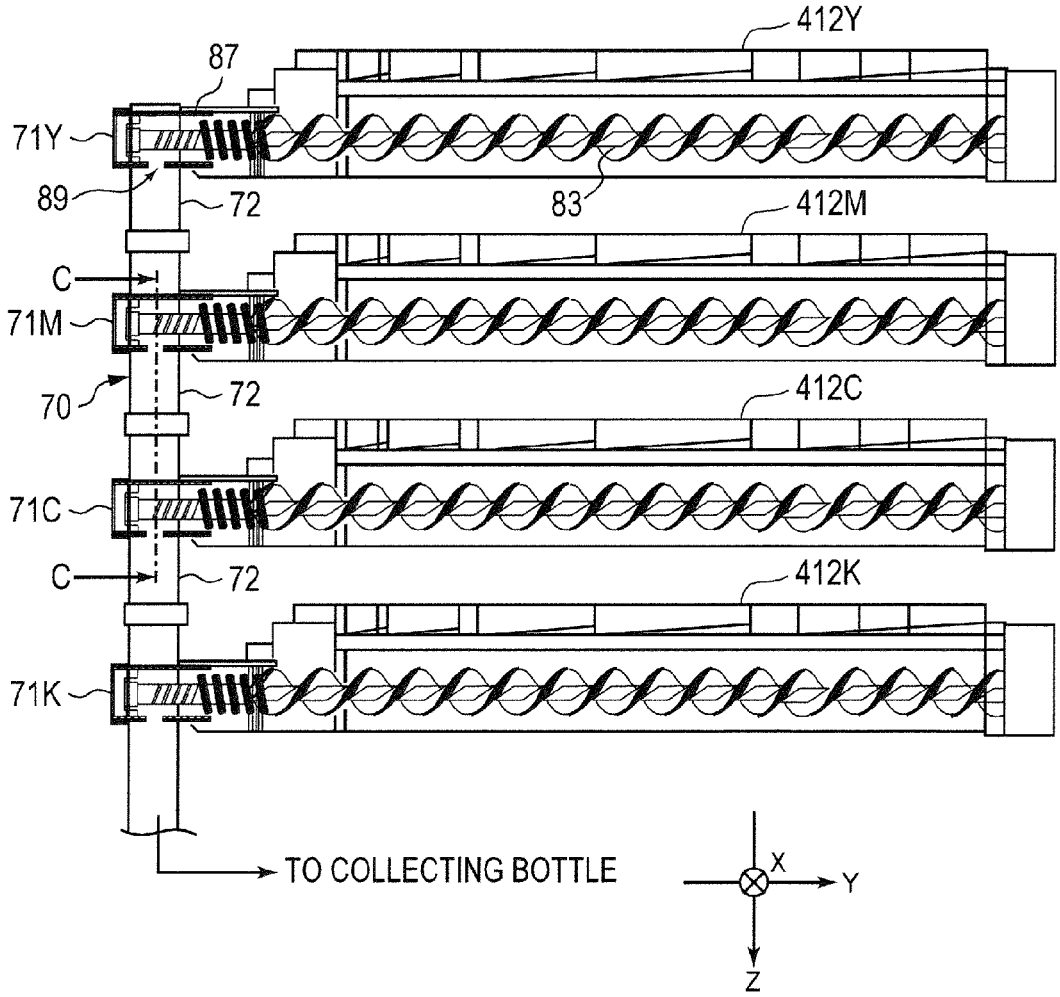
FIG. 6 is a sectional view of developing devices and a developer collecting duct in the image forming apparatus as viewed from the base end side in the X direction in the embodiment.
Figure 7:
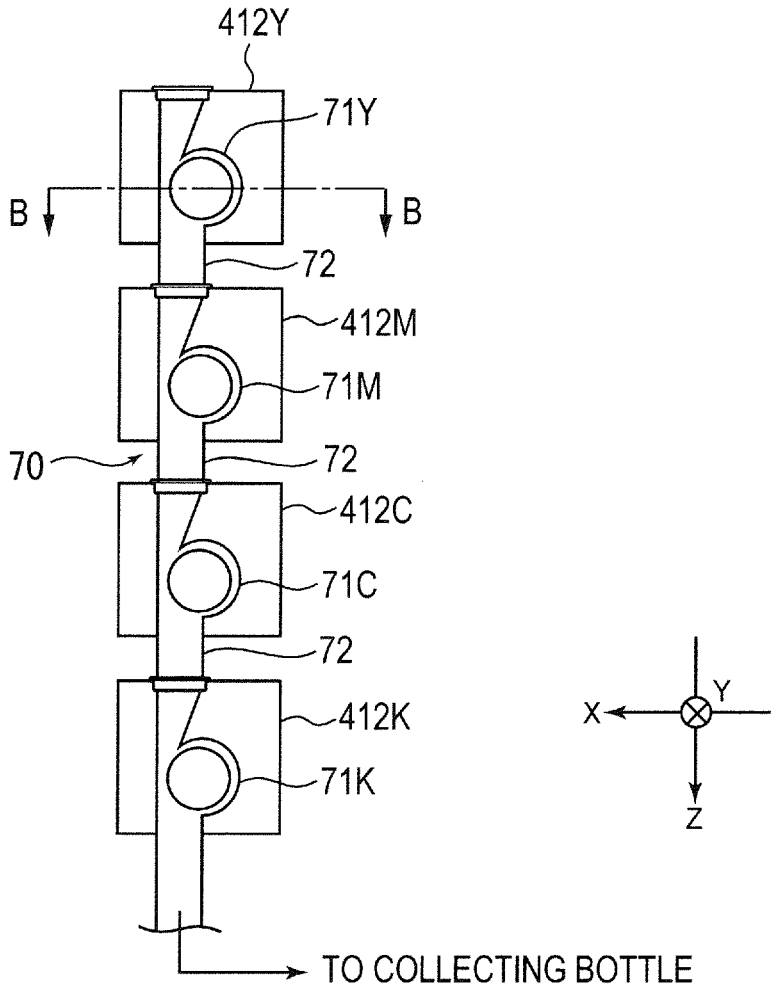
FIG. 7 illustrates the developing devices and the developer collecting duct in the image forming apparatus as viewed from the base end side in the Y direction in the embodiment.
Figure 8:
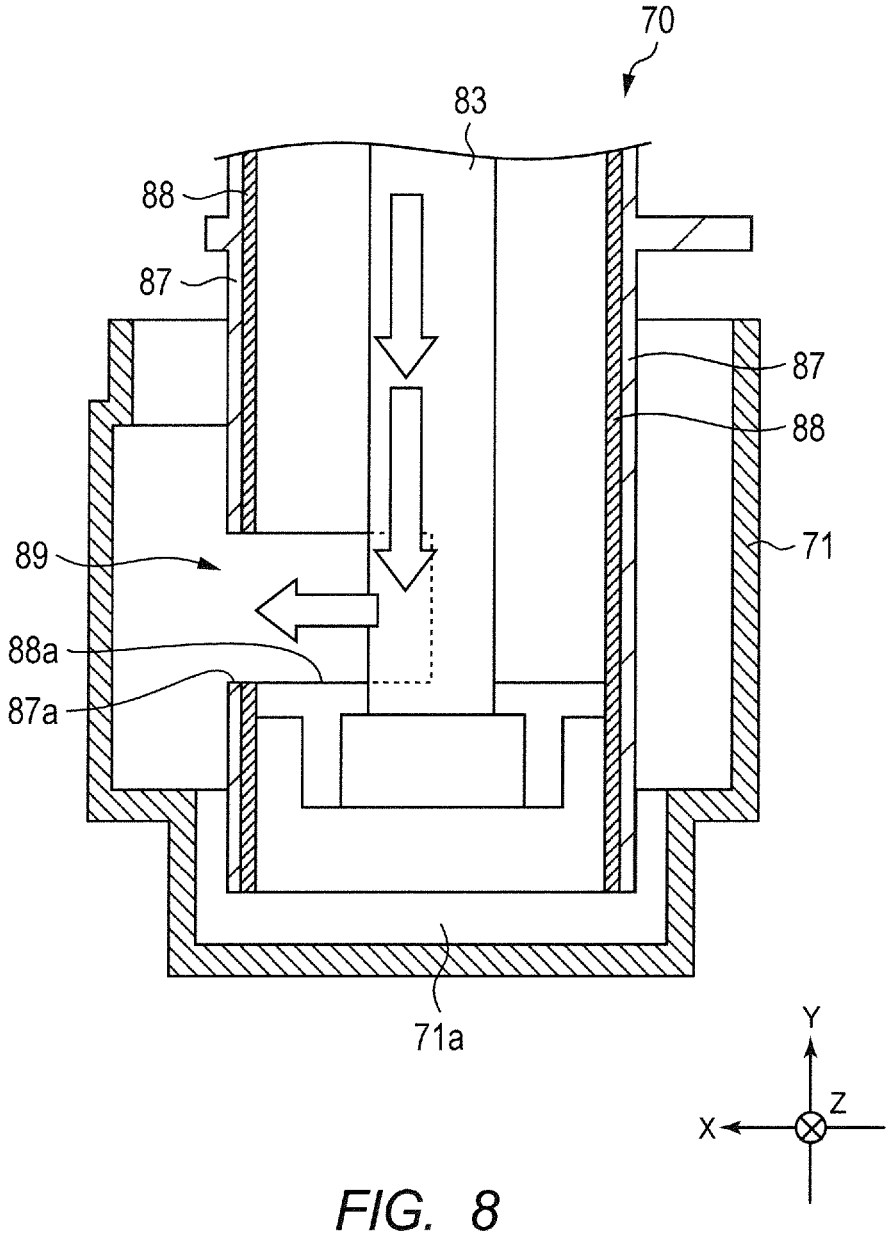
FIG. 8 is a sectional view along a line B-B in FIG. 7.

FIG. 5 illustrates an exemplary configuration of developing device 412. FIG. 6 is a sectional view of developing devices 412 and developer collecting duct 70 in image forming apparatus 1 as viewed from the base end side (the side opposite to the side on which photoconductor drum 413 is located) in the X direction. FIG. 7 illustrates developing devices 412 and developer collecting duct 70 in image forming apparatus 1 as viewed from the base end side in the Y direction. FIG. 8 is a sectional view along a line B-B in FIG. 7. In FIGS. 5 to 8, the X axis represents the horizontal direction, the Z axis represents the vertical direction, and the Y axis represents a direction orthogonal to the X and Z axes (the direction of the axis of agitating/conveying member 83).

As illustrated in FIGS. 6 and 7, image forming apparatus 1 includes four developing devices 412Y, 412M, 412C, and 412K disposed in tiers in the vertical direction (Z direction). Developing devices 412Y, 412M, 412C, and 412K are treated as individual units and detachably attached to image forming apparatus 1. For example, developing devices 412Y, 412M, 412C, and 412K are mounted on a process carriage (not shown) and collectively attached to image forming apparatus 1.

One end (on the base end side in the Y direction, i.e., the left side in FIG. 6) of each of developing devices 412Y, 412M, 412C, and 412K is coupled to developer collecting duct 70 linearly disposed in the vertical direction. The other end (on the tip end side in the Y direction, i.e., the right side in FIG. 6) of each of developing devices 412Y, 412M, 412C, and 412K is coupled to a power source (not shown), such as a driving motor, via a power transmission mechanism (not shown).

As illustrated in FIG. 5, developing device 412 includes developing roller 81 (toner bearing member), conveyance roller 82 (developer bearing member), agitating/conveying members 83 and 84, developer restriction member 85, developing container 86, and the like. That is, developing device 412 forms a toner image on photoconductor drum 413 according to what is called a hybrid development system, which combines a two-component development system and a mono-component development system.

The configuration of developing device 412 illustrated in FIG. 5 is exemplary: developing device 412 may be in any configuration as long as it discharges waste developer as in the trickle development system. A known trickle mechanism of circulation overflow type or liquid-level overflow type may be employed. The mechanism replaces deteriorated carrier with new carrier to maintain the toner in developing container 86 uniformly charged. This allows stable image quality to be achieved irrespective of the number of printed sheets or environmental variations.

Disposed in developing container 86 are, from the upstream to the downstream in the conveyance direction of the developer (from the right to the left in FIG. 5), agitating/conveying member 84, agitating/conveying member 83, conveyance roller 82, and developing roller 81.

Developing container 86 has developer inlet 86*a* for adding the developer (located substantially directly above agitating/conveying member 84 in FIG. 5). Toner supplied from a toner supplying section (not shown) and carrier supplied from a carrier supplying section (not shown) are mixed and added to developing container 86 through developer inlet 86*a*.

Agitating/conveying members 83 and 84, which are implemented by axially extending agitating screws, agitate the developer while circularly conveying the developer across agitating chambers 86*b* and 86*c*. This causes the toner and the carrier contained in the developer to be in frictional contact and charged with opposite polarities. It is assumed here that the carrier is positively charged and the toner is negatively charged.

The negatively charged toner attaches to the positively charged carrier around the carrier particles, mainly due to the electric attraction of the toner and the carrier. The developer is supplied to conveyance roller 82 while conveyed by agitating/conveying member 83.

Conveyance roller 82 is what is called a magnet roller, having unrotatably fixed magnet body 821 and cylindrical conveying sleeve 822 rotatably disposed around magnet body 821.

Developer restriction member 85, which is disposed substantially directly above conveyance roller 82, faces conveyance roller 82 at a certain distance from conveying sleeve 822. Developer restriction member 85 is a plate-like member implemented by a magnet body made of, e.g., stainless steel, and extends in parallel with conveyance roller 82.

Magnet body 821 has multiple magnetic poles (not shown) along the direction of the axis of conveyance roller 82. These magnetic poles create a magnetic field (magnetic field lines) for conveying sleeve 822 to convey the developer.

The developer supplied to conveying sleeve 822 presents what is called a magnetic brush, forming bristles along the magnetic field lines created by magnet body 821. The developer is conveyed counterclockwise with the rotation of conveying sleeve 822 and passes through a gap between conveying sleeve 822 and developer restriction member 85, thereby being restricted to a constant thickness.

Developing roller 81 is a conductive roller made of metal such as aluminum. Developing roller 81 may be a conductive roller coated with, e.g., polyester resin on the circumferential surface thereof.

Forming a magnetic field between developing roller 81 and conveyance roller 82 allows only the toner to be separated from the developer being conveyed by conveying sleeve 822, and to be supplied to developing roller 81. Developing roller 81 supplies the toner to photoconductor drum 413 to visualize the electrostatic latent image held on photoconductor drum 413.

In developing device 412, extra developer (waste developer) is conveyed by agitating/conveying member 83 and discharged to developer collecting duct 70 through developer outlet 89.

As illustrated in FIGS. 6 and 7, developer collecting duct 70 is a linear duct with four coupling portions 71Y, 71M, 71C, and 71K vertically spaced apart from each other. Here, developer collecting duct 70 has a shape of a rectangular pipe. One end (engaging portion 87 to be described below) of each of developing devices 412Y, 412M, 412C, and 412K is accommodated in corresponding coupling portion 71Y, 71M, 71C, or 71K and supported so as not to drop off. Duct portions between adjacent upper and lower coupling portions, i.e., coupling portions 71Y and 71M, coupling portions 71M and 71C, and coupling portions 71C and 71K, are intermediate ducts 72.

Coupling portions 71Y, 71M, 71C, and 71K have an arc shape bulging laterally as viewed from the base end side in the Y direction. That is, the main flow path through which the waste developer flows down is formed as a minimum path required, and the one end (engaging portion 87 to be described below) of each developing device 412 is exposed to the inside of the main flow path as little as possible.

As shown in FIGS. 6 and 8, engaging portion 87 projects from the one end of each of developing devices 412Y, 412M, 412C, and 412K: engaging portion 87 accommodates one end of agitating/conveying member 83 and is coupled to developer collecting duct 70. Engaging portion 87 is implemented by a cylindrical pipe member. On the base end side in the Y direction of engaging portion 87 (the part exposed to the inside of developer collecting duct 70), opening 87*a* is provided in an area including the bottom of the circumference of engaging portion 87.

Cylindrical shutter member 88 for the opening and closing of opening 87*a* fits the inside of engaging portion 87. Part of the circumference of shutter member 88 has opening 88*a* of substantially the same size as opening 87*a* of engaging portion 87. Shutter member 88 is energized toward the base end side in the Y direction, and before developing device 412 is attached to developer collecting duct 70, shutter member 88 projects from the base end side in the Y direction of engaging portion 87. In this state, opening 87*a* of engaging portion 87 is closed by the circumference of shutter member 88.

When developing device 412 is attached to developer collecting duct 70, shutter member 88 is pressed into engaging portion 87 by wall 71*a* of coupling portion 71 on the base end side in the Y direction. This causes opening 88*a* of shutter member 88 and opening 87*a* of engaging portion 87 to be aligned with each other to provide developer outlet 89. In developing device 412, deteriorated developer is conveyed by agitating/conveying member 83 and discharged through developer outlet 89 toward developer collecting duct 70, which communicates with a developer conveying path (agitating chamber 86*b*) in developing device 412.

The above configuration of engaging portion 87 and shutter member 88 are exemplary. What is required is that developer outlet 89 is opened when developing device 412 is attached to developer collecting duct 70, and closed when developing device 412 is detached from developer collecting duct 70.

Figure 9:
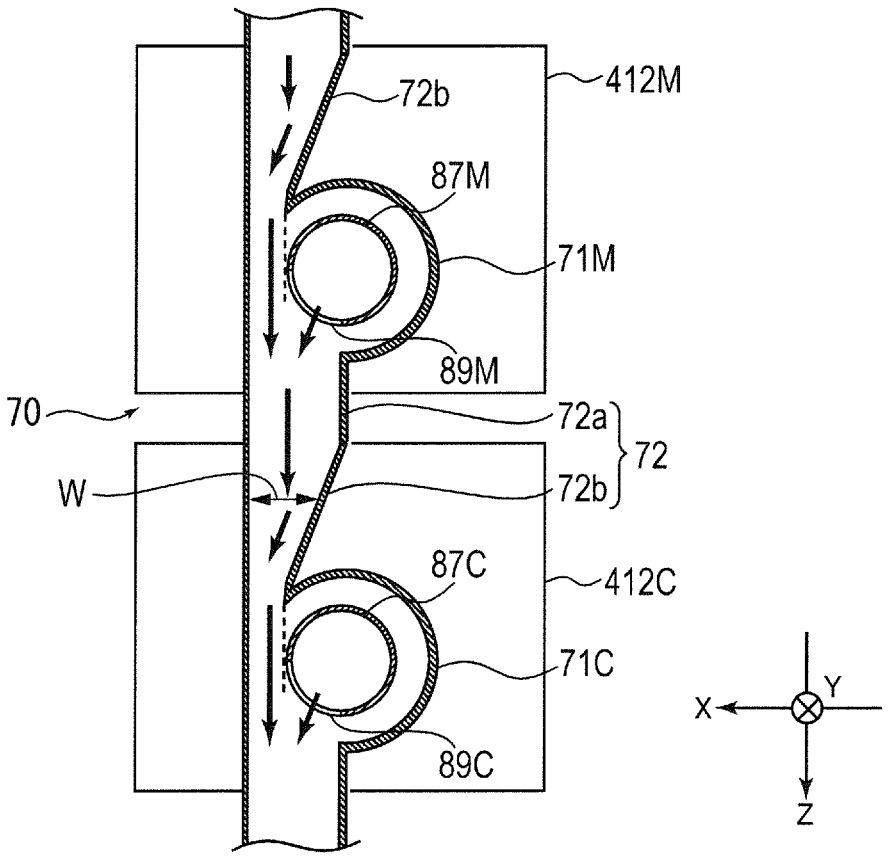
FIG. 9 is a sectional view illustrating an example of a flow path restricting portion in the developer collecting duct.

In this embodiment, developer collecting duct 70 has flow path restricting portions that restrict the area through which the waste developer flows down. For example, as shown in FIGS. 7 and 9, each flow path restricting portion is formed by the shape of intermediate duct 72. While intermediate duct 72 between coupling portions 71M and 71 C in developer collecting duct 70 will be described here, the description also applies to intermediate ducts 72 between coupling portions 71Y and 71M, and coupling portions 71C and 71K.

Specifically, as shown in FIG. 9, intermediate duct 72 has straight portion 72*a* following the bottom of coupling portion 71M, and sloped portion 72*b* following the bottom of straight portion 72*a*. The bottom of sloped portion 72*b* leads to the top of coupling portion 71C.

Straight portion 72*a* is disposed substantially directly below an edge of developer outlet 89M so that entire developer outlet 89M faces the main flow path. This allows the waste developer discharged through developer outlet 89M to be smoothly guided to intermediate duct 72 without being accumulated at the bottom of coupling portion 71M.

Sloped portion 72*b* is formed so that the flow of the waste developer discharged from upper developing device 412M is deflected from engaging portion 87C of lower developing device 412C. Sloped portion 72*b* preferably completely covers the upper surface of engaging portion 87C of lower developing device 412C. This can prevent the waste developer from being accumulated on engaging portion 87C.

Sloped portion 72*b* is also preferably sloped with a downwardly decreasing width W of the duct as viewed from the base end side in the Y direction. This can ensure that the waste developer is guided to bypass engaging portion 87C, thereby effectively preventing the waste developer from being accumulated on engaging portion 87C.

Thus, image forming apparatus 1 includes developer collecting duct 70 that is linear and has multiple coupling portions 71 vertically spaced apart from each other. Image forming apparatus 1 also includes multiple developing devices 412 (developer discharging sections) that each have engaging portion 87 inserted into coupling portion 71 to thereby be disposed as being exposed to the inside of developer collecting duct 70, and that discharge the waste developer to developer collecting duct 70 through developer outlet 89 provided in engaging portion 87.

Among developing devices 412, second and subsequent developing devices 412M, 412C, and 412K from the top are detachably attached to developer collecting duct 70.

Developer collecting duct 70 has the flow path restricting portions (for example, intermediate ducts 72) that each restricts the area through which the waste developer flows down to prevent the waste developer from hitting engaging portion 87 of lower developing device 412 (for example, developing device 412C for developing device 412M).

Image forming apparatus 1 can prevent the waste developer from being accumulated on engaging portions 87 of developing devices 412, thus ensuring prevention of scattering of the waste developer when developing devices 412 are detached from developer collecting duct 70.

Therefore, image forming apparatus 1 can prevent the occurrence of poor images due to scattered waste developer.

While the present invention made by the inventor has been specifically described above on the basis of the embodiment, the present invention is not limited to the above embodiment but can be modified without departing from its spirit.

Figure 10:
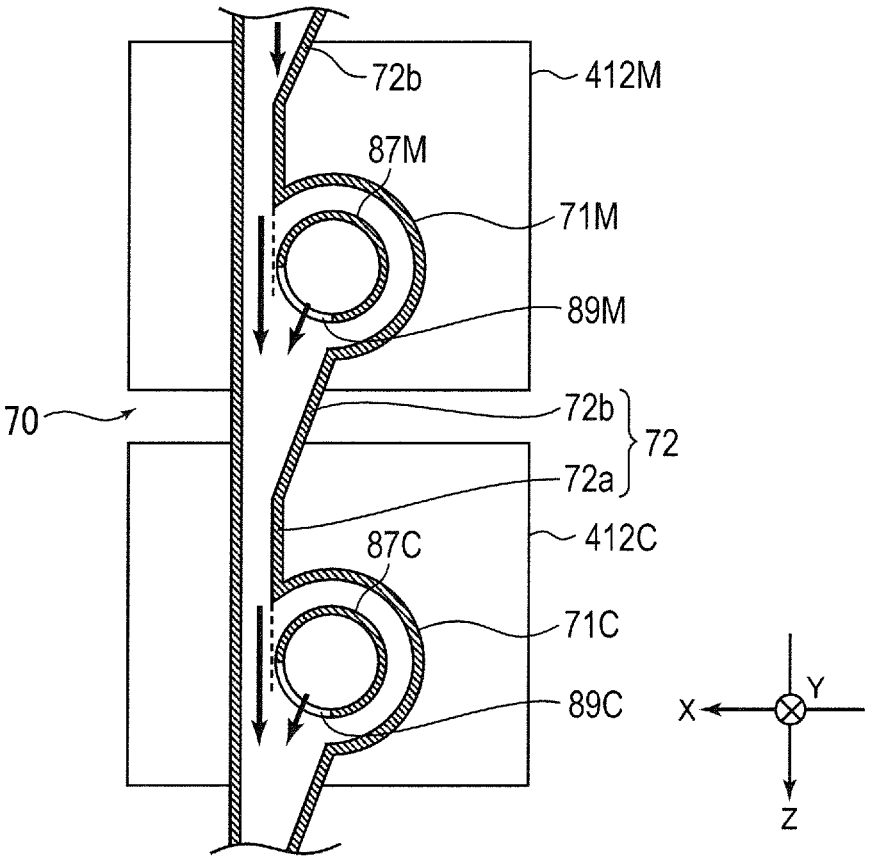
FIG. 10 is a sectional view illustrating another example of the flow path restricting portion in the developer collecting duct.
Figure 11:
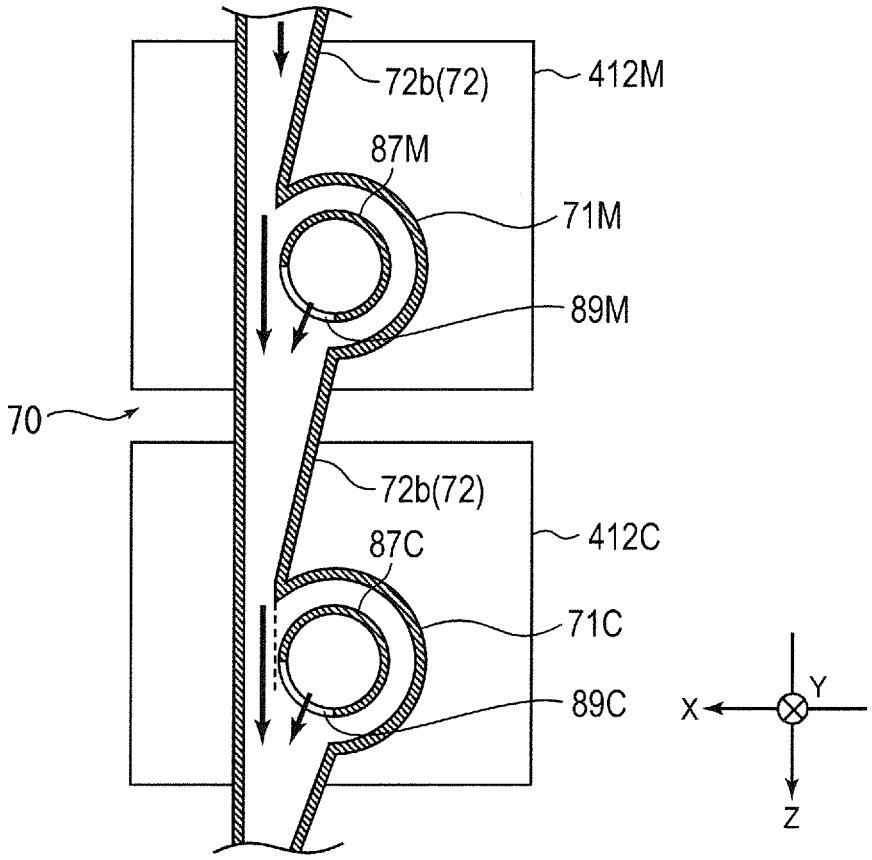
FIG. 11 is a sectional view illustrating another example of the flow path restricting portion in the developer collecting duct.

For example, in the embodiment, intermediate duct 72 includes straight portion 72*a* in the upper part and sloped portion 72*b* in the lower part. Alternatively, as shown in FIG. 10, sloped portion 72*b* may be in the upper part and straight portion 72*a* may be in the lower part. Also, as shown in FIG. 11, intermediate duct 72 may include only sloped portion 72*b*.

Figure 12:
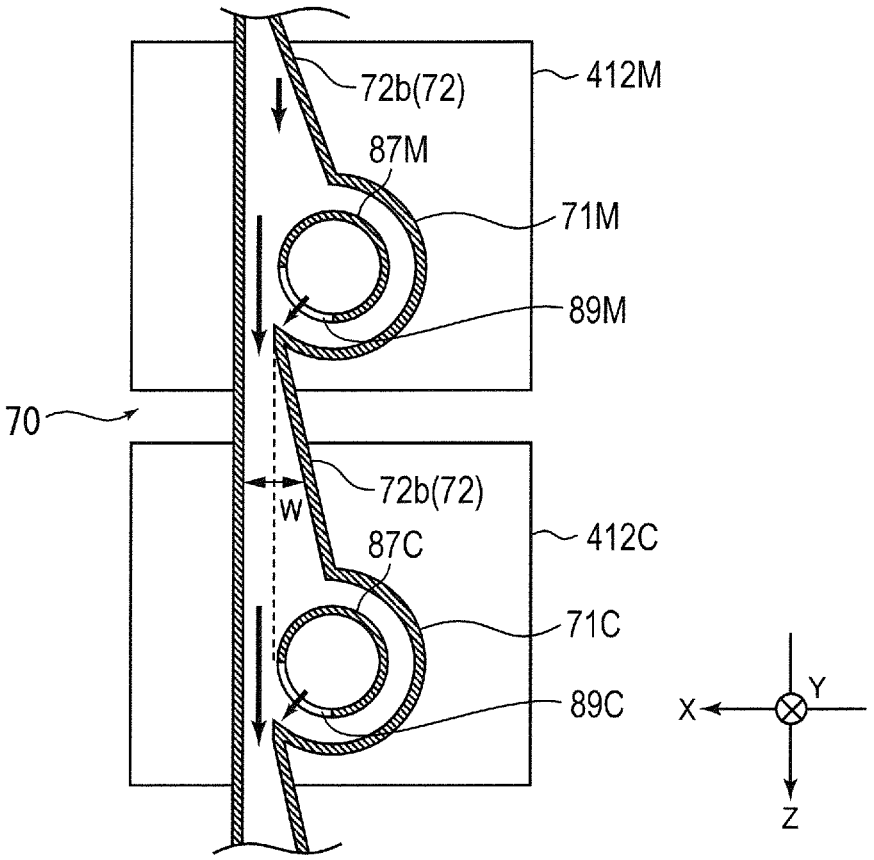
FIG. 12 is a sectional view illustrating another example of the flow path restricting portion in the developer collecting duct.

As shown in FIG. 12, sloped portion 72*b* may be sloped with a downwardly increasing width W of the duct as viewed from the base end side in the Y direction. The waste developer can still be prevented from being accumulated on engaging portion 87C of lower developing device 412C, because engaging portion 87C is covered by sloped portion 72*b*.

In this case, the waste developer discharged through developer outlet 89M may be accumulated at the bottom of coupling portion 71M. However, the waste developer accumulated to some degree is negligible because the accumulated waste developer will not be scattered when developing device 412M is detached.

Intermediate duct 72 may also include a combination of a straight portion (not shown) and sloped portion 72*b* with a downwardly increasing width W of the duct as viewed from the base end side in the Y direction.

Figure 13:
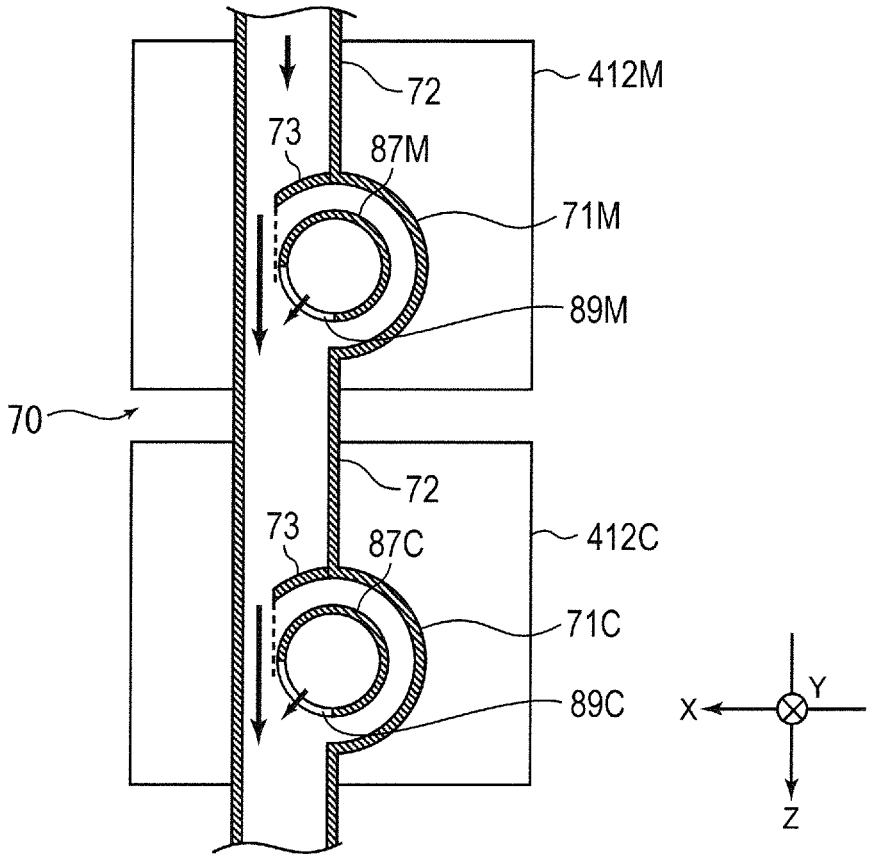
FIG. 13 is a sectional view illustrating another example of the flow path restricting portion in the developer collecting duct.

In FIGS. 9 to 12, the flow path restricting portion is formed by the shape of intermediate duct 72 provided between two upper and lower coupling portions 71M and 71C. Alternatively, as shown in FIG. 13, hood portion 73 projecting inside intermediate ducts 72 may be provided as the flow path restricting portion. Although hood portion 73 has an arc shape along the outlines of engaging portions 87M and 87C in FIG. 13, hood portion 73 may have a linearly sloped shape.

Hood portion 73 may be provided at any position in intermediate duct 72, for example at the bottom end of intermediate duct 72 (see FIG. 13) or at the middle of intermediate duct 72. However, to effectively prevent the waste developer from being accumulated on engaging portion 87C, hood portion 73 is preferably provided near engaging portion 87C of lower developing device 412C.

If hood portion 73 is provided as the flow path restricting portion as above, hood portion 73 preferably completely covers the upper surface of engaging portion 87C of lower developing device 412C.

Image forming apparatus 1 includes drum cleaning devices 415 for cleaning the toner remaining in photoconductor drums 413 after image formation. The present invention is also applicable for the case in which drum cleaning devices 415 are coupled in tiers to developer collecting duct 70.

That is, the present invention is suitable for the case in which developer discharging sections, such as developing devices 412 or drum cleaning devices 415, are disposed in tiers and detachably attached to developer collecting duct 70.

The embodiment disclosed herein should be considered as exemplary and not limitation in all respects. The scope of the present invention is defined by the appended claims rather than by the above description, and is intended to include all modifications within the meaning and scope equivalent to the appended claims.

What is claimed is:

1. An image forming apparatus comprising:

a developer collecting duct that is linear and has a plurality of coupling portions vertically spaced apart from each other; and a plurality of developer discharging sections that each have an engaging portion inserted into one of the coupling portions to thereby be disposed as being exposed to the inside of the developer collecting duct, and that discharge waste developer to the developer collecting duct through a developer outlet provided in the engaging portion, wherein second and subsequent ones of the developer discharging sections from the top are detachably attached to the developer collecting duct, and the developer collecting duct has a main flow path that each of the developer outlets face, and through which the waste developer flows down, and a sloped portion or a hood portion that guides the waste developer to the main flow path and prevents the waste developer from hitting the engaging portion of a lower one of the developer discharging sections.

2. The image forming apparatus according to claim 1, wherein the sloped portion or the hood portion completely covers the upper surface of the engaging portion of the lower one of the developer discharging sections.

3. The image forming apparatus according to claim 1, wherein the sloped portion or the hood portion is formed by the shape of an intermediate duct provided between two adjacent upper and lower ones of the coupling portions.

4. The image forming apparatus according to claim 3, wherein part or all of the intermediate duct is sloped so that a lower part of the intermediate duct has a narrower width than an upper part thereof.

5. The image forming apparatus according to claim 1, wherein the hood portion projects inside an intermediate duct provided between two adjacent upper and lower ones of the coupling portions.

6. The image forming apparatus according to claim 1, wherein each developer discharging section is a developing device that performs development by attaching toner to an electrostatic latent image formed on a photoconductor drum.

7. The image forming apparatus according to claim 1, wherein each developer discharging section is a cleaning device that cleans toner remaining on a photoconductor drum.

* * * * *